US009334789B2

(12) United States Patent
Van Rooyen

(10) Patent No.: US 9,334,789 B2
(45) Date of Patent: May 10, 2016

(54) TWO STROKE ENGINE PORTING ARRANGEMENT

(75) Inventor: Basil Van Rooyen, St. Ives (AU)

(73) Assignee: CITS ENGINEERING PTY LTD, St. Ives (AU)

( * ) Notice: Subject to any disclaimer, the term of this patent is extended or adjusted under 35 U.S.C. 154(b) by 0 days.

(21) Appl. No.: 13/884,273

(22) PCT Filed: Nov. 11, 2011

(86) PCT No.: PCT/AU2011/001456

§ 371 (c)(1),
(2), (4) Date: May 9, 2013

(87) PCT Pub. No.: WO2012/061894

PCT Pub. Date: May 18, 2012

(65) Prior Publication Data

US 2013/0228158 A1 Sep. 5, 2013

(30) Foreign Application Priority Data

Nov. 12, 2010 (AU) ..... 2010241402

(51) Int. Cl.

| | |
|---|---|
| ***F02B 25/00*** | (2006.01) |
| ***F02B 25/02*** | (2006.01) |
| ***F02B 33/12*** | (2006.01) |
| ***F02B 33/20*** | (2006.01) |
| ***F02M 35/116*** | (2006.01) |
| ***F02B 25/26*** | (2006.01) |
| *F02B 75/02* | (2006.01) |

(52) U.S. Cl.

CPC ..... *F02B 25/00* (2013.01); *F02B 25/02* (2013.01); *F02B 25/26* (2013.01); *F02B 33/12* (2013.01); *F02B 33/20* (2013.01); *F02M 35/116* (2013.01); *F02B 2075/025* (2013.01)

(58) Field of Classification Search

CPC ..... F02B 33/20; F02B 25/02; F02B 33/10; F02B 33/12; F02M 35/116; F02M 35/112

USPC ..... 123/347, 65 V, 65 P, 61 V, 66, 71 R

See application file for complete search history.

(56) References Cited

U.S. PATENT DOCUMENTS

| | | | | |
|---|---|---|---|---|
| 948,336 A * | 2/1910 | Moore | ..... | 123/65 A |
| 4,161,163 A * | 7/1979 | Boyesen | ..... | F01L 3/205 123/73 A |
| 6,223,705 B1 * | 5/2001 | Sato et al. | ..... | 123/73 PP |

FOREIGN PATENT DOCUMENTS

| | | | | |
|---|---|---|---|---|
| AU | 2009238281 | 10/2010 | | |
| AU | 2009238281 B1 * | 10/2010 | ..... | F02M 35/104 |

* cited by examiner

*Primary Examiner* — Lindsay Low
*Assistant Examiner* — Kevin Lathers
(74) *Attorney, Agent, or Firm* — Mark M. Friedman

(57) ABSTRACT

A gas transfer port system for a cylinder of a two stroke internal combustion engine; said cylinder provided with a fixed separator plate dividing said cylinder into an upper section and a lower section; a piston in said cylinder reciprocating between said separator plate and a cylinder head; and wherein an annular skirt descending from said separator plate forms at least a portion of an annular well between said skirt and an internal surface of said cylinder; said well sealed at the bottom such that said cylinder is isolated from a crankcase of said engine; said gas transfer port system including at least one long gas transfer port connecting a lower portion of said annular well with a gas transfer port outlet aperture in a wall of said cylinder.

20 Claims, 3 Drawing Sheets

TWO STROKE ENGINE PORTING ARRANGEMENT

The present invention relates to two-stroke engines and, more particularly, to the transfer of gasses within the cylinder of such engines.

BACKGROUND

The advantages of typical two-stroke internal combustion engines, which include relatively higher power to weight ratio over a comparable displacement four-stroke engine and fewer moving parts, is offset by the following disadvantages:

Two-stroke engines typically cannot use a pressurised lubrication system and instead, oil is added to the air/fuel mixture to allow lubrication of the piston within the cylinder and the roller bearings on the crankshaft.

Thus two-stroke engines burn oil, accounting for unwanted pollution.

A lack of a pressurised lubrication system requires roller bearings on the crankshaft and con-rods which are able to operate in the oil/fuel mix, unlike cheaper and simpler slipper bearings. This requires a heavy and expensive crankshaft assembly, to permit roller-bearing fitment.

In a previous application AU2009238281, the present applicant has disclosed a twin cylinder two-stroke engine arrangement in which each cylinder is divided into upper and lower cylinder sections by a fixed separator plate, with each piston moving reciprocatingly in the upper section between the separator plate and the cylinder head.

While this arrangement has the enormous advantages of allowing an increased primary compression ratio, pressure lubrication of the piston and simpler and cheaper crankshaft construction to name but some, the transfer of gasses from their initial induction into the area between the separator plate and the underside of the piston, into the combustion chamber above the piston, was found to be less than optimum.

It is an object of the present invention to address or at least ameliorate some of the above disadvantages.

Notes

1. The term "comprising" (and grammatical variations thereof) is used in this specification in the inclusive sense of "having" or "including", and not in the exclusive sense of "consisting only of".
2. The above discussion of the prior art in the Background of the invention, is not an admission that any information discussed therein is citable prior art or part of the common general knowledge of persons skilled in the art in any country.

BRIEF DESCRIPTION OF INVENTION

Accordingly, in a first broad form of the invention, there is provided a gas transfer port system for a cylinder of a two-stroke internal combustion engine; said cylinder provided with a fixed separator plate dividing said cylinder into an upper section, and a lower section; a piston in said cylinder reciprocating between said separator plate and a cylinder head; and wherein an annular skirt descending from said separator plate forms at least a portion of an annular well between said skirt and an internal surface of said cylinder; said well sealed at the bottom such that said cylinder is isolated from a crankcase of said engine; said gas transfer port system including at least one long gas transfer port connecting a lower portion of said annular well with a gas transfer port outlet aperture in a wall of said cylinder.

Preferably, said long gas transfer port is one of at least one pair of gas transfer ports; each said pair of gas transfer ports including a short gas transfer port and a said long gas transfer port.

Preferably, said fixed separator plate forms an upper closure of said annular skirt; the diameter of an outer surface of said annular skirt being smaller than the bore of said cylinder, such that an annular well is formed between said outer surface and said bore of said cylinder for at least a part of the circumference of said annular skirt.

Preferably, said fixed separator plate and said annular skirt isolate said upper section of said cylinder from a crankcase of said engine; a lower edge of said annular skirt sealing against an annular ledge at a base of said cylinder.

Preferably, said well is of sufficient depth to accommodate an exhaust control skirt when said piston descends to BDC; said exhaust control skirt depending from an underside rim of said piston.

Preferably, an exhaust port of said cylinder is arranged diametrically opposite an inlet port of said cylinder.

Preferably, said cylinder is provided with four pairs of said gas transfer ports; said four pairs arranged in two diametrically opposing pairs of pairs between said exhaust port and said inlet port.

Preferably, each said short gas transfer port has an inlet aperture proximate an upper surface of said separator plate; said short gas transfer port having an outlet aperture above an upper surface of said piston when said piston is at BDC.

Preferably, each said long gas transfer port has an inlet proximate the bottom of said annular well; said long gas transfer port having an outlet aperture common with said outlet aperture of a corresponding short gas transfer port of said pair of gas transfer ports.

Preferably, a single gas transfer port is arranged aligned axially with an outlet aperture of said inlet port; said single gas transfer port extending from below said upper surface of said separator plate to above said upper surface of said piston when said piston is at BDC; an outlet aperture of said inlet port communicating with said single gas transfer port.

Preferably, said piston is provided with an inlet port control skirt; said inlet port control skirt depending from said lower edge of said piston sufficient to block passage of gas from between an underside of said piston and said upper surface of said separator plate, into said outlet aperture of said inlet port when said piston descends to BDC; said skirt extending below said upper surface of said separator plate when said piston is at BDC.

Preferably, passages of said short and long gas transfer ports are curved proximate said common outlet apertures such that gas flows issuing from said common outlet apertures are biased in flow direction towards and above said inlet port.

Preferably, a portion of said annular well is blocked so as to reduce the volume of said well, said reduction in volume increasing the available compression ratio of said cylinder.

Preferably, an underside of said piston is shaped with angled surfaces sweeping upward from a diametric centreline lying between an inlet port side and an exhaust port side of said cylinder; said angled surfaces directing gas flow from between said underside of said piston and said upper surface of said separator plate into said inlet apertures of said short gas transfer ports as said piston approaches BDC.

In another broad form of the invention, there is provided a method of transferring gasses from an underside of a piston of a cylinder of a two-stroke engine; said method including the steps of providing at least one long gas transfer ports extending from an inlet aperture proximate a bottom portion of an annular well to an outlet aperture located above an upper surface of said piston when said piston is at BDC; said annular well formed between an inside surface of said cylinder and an annular skirt depending from a fixed separator plate.

Preferably, said long gas transfer port is one of a pair of gas transfer ports; a second of said pair of transfer ports being a short gas transfer port extending from a level below an underside of said piston to said outlet aperture above said upper surface of said piston when said piston is at BDC in said cylinder; said short gas transfer port having an outlet aperture common with said long gas transfer port.

Preferably, said annular well at least partially surrounds said annular skirt depending from said fixed separator plate; said separator plate and said annular skirt isolating an upper section of said cylinder from a crankcase of said engine.

Preferably, a charge of gas comprising air or an air/fuel mixture is drawn through an inlet port into a volume defined by said annular well and between, said underside of said piston and an upper surface of said fixed separator plate, as said piston rises toward TDC.

Preferably, said charge of gas is compressed into said volume as said piston descends from TDC towards BDC; pressure in said pair of gas transfer ports rising to a maximum until said upper surface of said piston descends below an upper edge of said outlet aperture of said pair of gas transfer ports; said charge then commencing issuing from said outlet aperture.

Preferably, transfer of said charge is boosted by a rapid rise in pressure as separation between said underside of said piston and said upper surface of said separator plate approaches a minimum; said rapid rise in pressure causing an accelerated transfer of said gas through said short transfer port.

Preferably, a single gas transfer port directs a flow of said charge across an upper surface of said piston as said piston approaches BDC; said single gas transfer port communicating with an outlet aperture of an inlet port of said cylinder; said single gas transfer port extending from a level below said separator plate to a level above said upper surface of said piston.

Preferably, said piston is provided with a short inlet port skirt depending from an edge of said piston; said short inlet skirt substantially coextensive with said outlet aperture of said inlet port when said piston is at BDC.

BRIEF DESCRIPTION OF DRAWINGS

Embodiments of the present invention will now be described with reference to the accompanying drawings wherein.

DETAILED DESCRIPTION OF PREFERRED EMBODIMENTS

Figure 1:
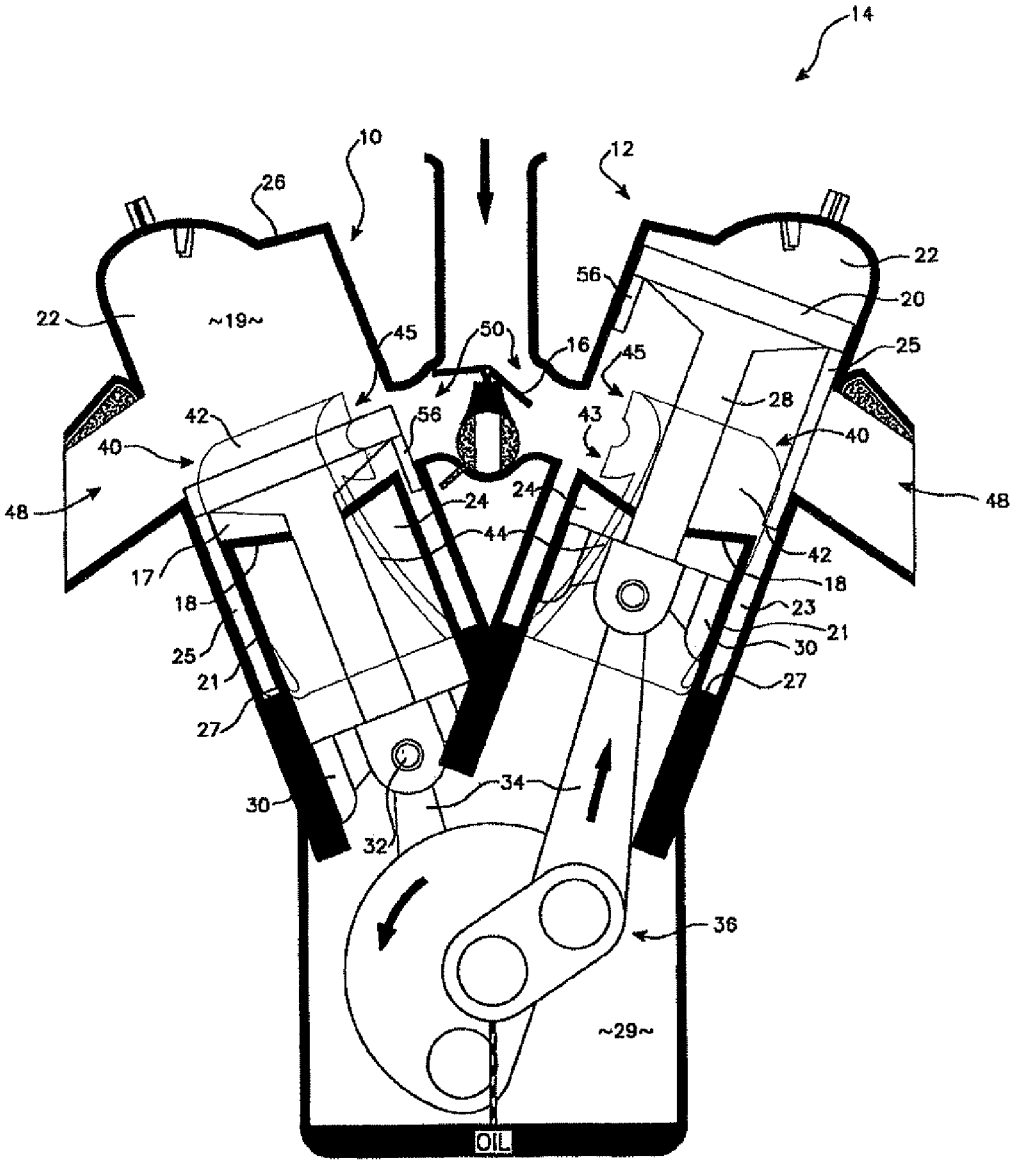
FIG. 1 is a simplified schematic representation of a two-stroke internal combustion engine employing the porting arrangement of the invention.
Figure 2:
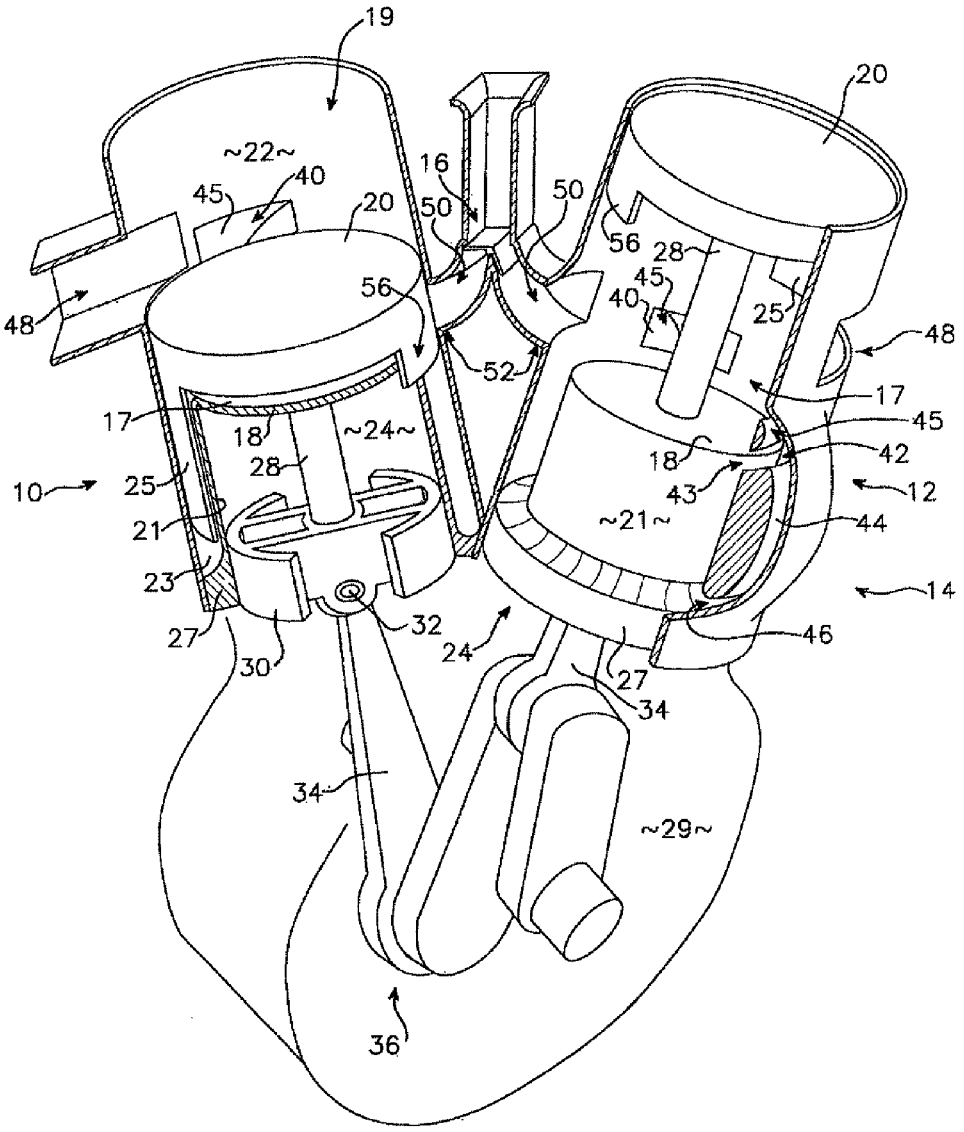
FIG. 2 is a sectioned view of paired cylinders and associated components of a two-stroke engine incorporating the porting arrangement of FIG. 1.

With reference to FIGS. 1 and 2, in a preferred arrangement, the porting system of the present invention, is applied to paired cylinders 10 and 12 of a two-stroke engine 14. Engines employing the invention may be two cylinder or other combinations of paired cylinders, thus four, six or eight cylinder engines for example, although the porting arrangement of the invention may be applied also to single cylinder engines. However the following description focuses on one of the cylinders (the "first cylinder" and its associated features) of cylinders paired in "V" formation, in which the pistons move at 180o separation so that when the first cylinder is at top dead centre (TAC) the other is at bottom dead centre (BDC).

Preferably also, in the case of paired cylinders such as shown in FIGS. 1 and 2, the engine 14 is provided with an inlet pivot valve 16 arrangement previously described in the applicant's earlier filing AU2009238281. As will become apparent, the porting arrangement of the present invention adds significantly to the working, integrity and efficiency of the pivot valve invention.

The porting system of the present invention is applicable to engines in which each of the cylinders is divided by a fixed separator plate 18 into upper and lower cylinder sections 22 and 24 respectively, with the piston 20 reciprocating in the upper section 22 between the separator plate 18 and cylinder head 26 (removed in FIG. 2). Thus the piston 20 divides its upper cylinder section 22 into a combustion chamber portion 19 above the piston and an induction or pressure chamber portion 17 between the underside of the piston 20 and the upper surface of the separator plate 18.

A post 28, passing trough an aperture in the separator plate 18, interconnects the piston 20 with a guide element 30, which reciprocates with the piston in the lower cylinder section 24. The guide element 30 is pivotally connected by a gudgeon pin 32 to a connecting rod 34, which in turn is rotationally connected to a crankshaft journal 36, in the normal manner.

This lower section of the cylinder is of smaller diameter than the bore of the upper cylinder section, and in effect is an insert into the main cylinder body, forming an inverted "beaker" or "thimble" shape comprising the separator plate 18 and an annular skirt 21 depending from the plate 18. The outer diameter of the annular skirt 21 is such as to form an annular well 23 between the bore of the main cylinder body and the annular skirt 21. This well 23 is of sufficient depth to accommodate an exhaust port control skirt 25 which depends from the underside rim of the piston 20, as is common in two-stroke engines.

The lower rim of the annular skirt 21 is sealed against a ledge 27 in the cylinder 10 so that the upper cylinder section and annular well are isolated from the crankcase void 29 of the engine.

Each cylinder 10, 12, is provided with at least one long gas transfer port 44. Preferably the at least one long gas transfer port 44 is one of a pair of gas transfer ports 40. The other of the pair of gas transfer ports is a short transfer port 42.

The long gas transfer port 44 of the pair of transfer ports extends from an aperture 46 proximate to the bottom of the annular well 23, to the shared common outlet aperture 45 of the short transfer port 42. As can be seen from the schematic representation of FIG. 1, the short transfer port 42 extends from an inlet aperture 43 located in the wall of the upper cylinder section between the upper surface of the fixed separator plate 18 and the underside of the piston 20, to an outlet aperture 45 in the cylinder wall above the upper surface of the piston when this is at BDC.

Preferably, the engine for application of the transfer port system of the present invention, is a cross flow engine, in that the exhaust port 48 and the inlet port 50 are located at diametrically opposite sides of the cylinder. Although only a single pair of gas transfer ports are shown in the drawings for clarity, the transfer port system of the invention may include multiple pairs, preferably, four pairs of short and long transfer ports, with two pairs of pairs located diametrically opposed between the exhaust port 48 and the inlet port 50, as can be seen from FIG. 3. Preferably, the lower edge of exhaust port 48, inlet port 50 and the outlet apertures 45 of the four pairs of transfer ports are located at the same level in the cylinder wall as the upper surface of the piston 20 when this is at BDC. The locations of the upper edges of these ports are critical to the opening of the ports by the descending piston, to allow firstly, the exhaust gasses to start to exit through the exhaust port, and then opening the transfer ports. The outlet aperture of the inlet port 50 lies somewhat below the level of the lower lip of the exhaust port 48.

Figure 3:
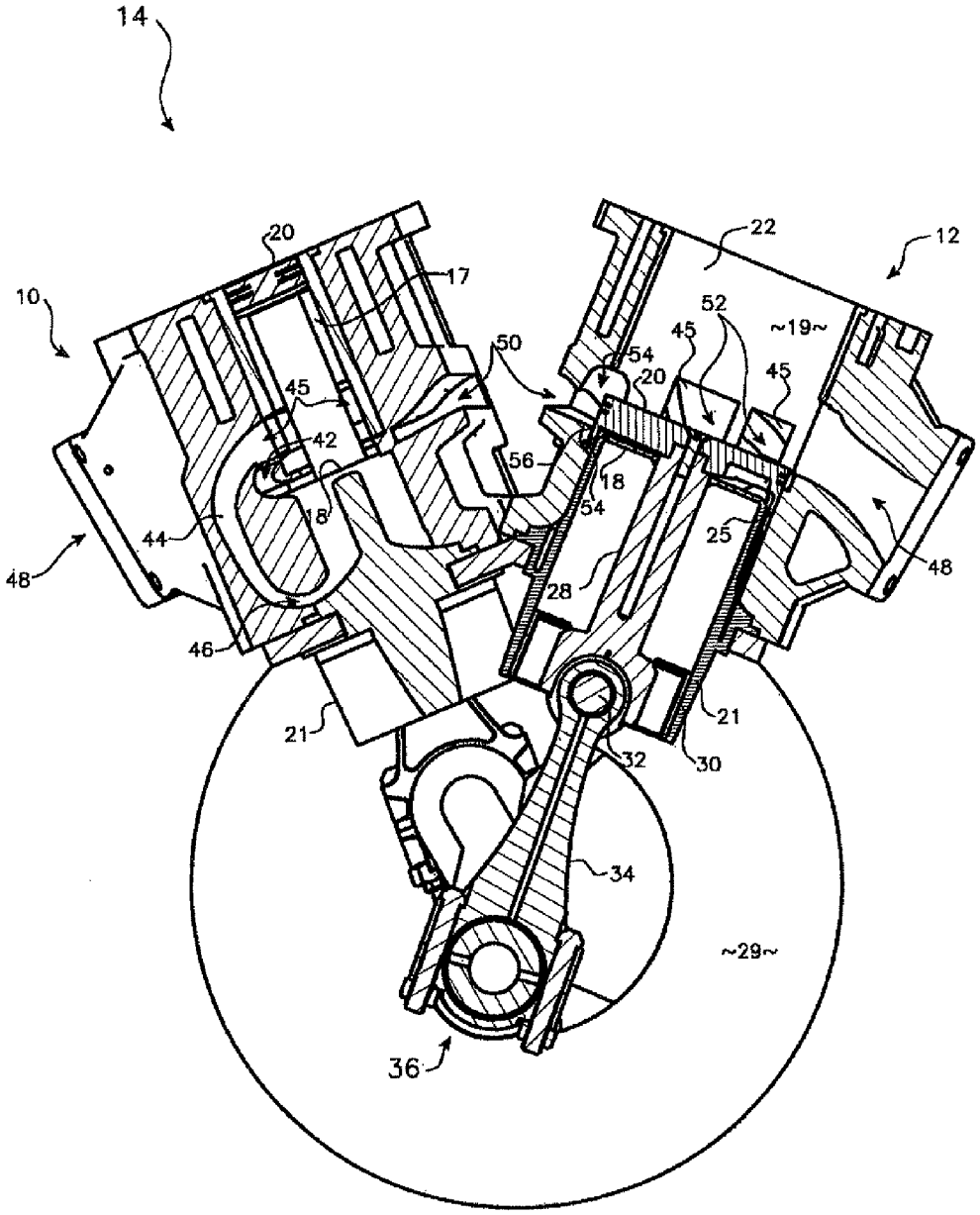
FIG. 3 is further sectioned view of the paired cylinders of FIG. 2.

As best seen from the vertically oriented cylinder 12 in FIG. 3, the passages 52 linking the short and long gas transfer ports from their respective inlet apertures to their common outlet aperture 45, are so curved, adjacent the outlet apertures, as to direct a flow of gas issuing from the apertures, towards the inlet port 50, assisting in the scavenging of exhaust gasses from the combustion chamber 22.

It can be seen from FIGS. 2 and 3 that the system of the invention provides the typical and common further single transfer port 54. This single gas transfer port 54 extends from a level below that of the upper surface of the fixed separator plate 18 to a point somewhat above the upper surface of the piston 20 when the piston is at BDC.

This type of gas transfer port is commonly used in modern two-stroke engines and is known the booster transfer port. It forms a vertical projection of the inlet port 50, connecting the port with the combustion chamber 22 when the piston is near BDC, allowing further communication between the network of the transfer ports connecting the induction/pressure chamber portion 17 and the combustion chamber portion 19 respectively formed below and above the piston 20.

The function of the booster transfer port 54 in known two-stroke engines, is to increase charge transfer from the induction/pressure chamber portion to the combustion chamber portion of the cylinder, as well as to clear any residual burnt charges from the top of the piston. Because the gas issuing from this transfer port is directed towards exhaust port (unlike the paired transfer port passages as described below which direct their gas flow towards the inlet port side of the cylinder), the size of the booster port is kept relatively small, since any excess charge would be lost through the exhaust port, a condition known as short circuiting.

In the present invention, this single gas transfer port 54 at the inlet port outlet, has an additional function. The great outrush of an exhaust slug down the exhaust pipe after the piston 20 has opened the exhaust port 48, lowers the residual pressure in the combustion chamber portion 19 to below ambient atmospheric pressure, drawing in the fresh charge from the induction/pressure chamber portion 17 below the piston 20 through the paired transfer ports 40, as soon as the descending piston 20 clears the upper edges of the transfer port outlet apertures 45. The single transfer port 54 which is in effect an extension of the inlet port, then opens to clear any residual burnt gasses from the upper surface of the piston, which may be left behind due to the trajectories of the transfer ports which are aimed at the inlet side of the cylinder. The single gas transfer port 54 provides the most direct route from the exhaust port 48 to the inlet port 50, so that the lowered pressure, or suction, is communicated via this single transfer port 54 with more immediacy to the still closed pivot valve 16, causing it to start opening.

Without this exhaust dynamic, the piston on its rise from BDC, can "draw-back", through the transfer ports 40, from the combustion chamber portion 19 to the induction/pressure chamber portion 17, instead of from the inlet port 50, until such time as the ascending piston 20 rises past, and closes off the outlet apertures 45 of the transfer ports 40, and before the pivot valve 16 will open under the suction created only once the piston has passed this point.

This delay is reduced or eliminated by the aforementioned exhaust scavenge. By contrast, the opposing piston of the other, second cylinder 12 of the paired cylinders, as it starts its descent from TDC, will immediately start to pressurise the induction/pressure portion 17 of that cylinder, and cause that leaf of the pivot valve operating in its inlet port to start closing. Since the two leaves of the pivot valve (although allowing some flexure) are rigidly interconnected, this rising pressure aids in the opening movement of the pivot valve leaf of the first cylinder 10. Thus the two forces from the opposing pistons moving between BDC and TDC respectively will be working in close concert. Any remaining lead or lag of the closing and opening fluid dynamics acting on the pivot valve leaves from the opposing piston movements, will be accommodated by the flexing allowed for in the design of the composite material of the interconnected leaves.

Not visible in the drawings, is a feature of the underside of piston 20 which is shaped with angled surfaces sweeping upward from a diametric centreline lying between an inlet port side and an exhaust port side of the cylinder. These angled surfaces direct gas flow from between the underside of the piston 20 and the upper surface of the fixed separator plate 18 towards the inlet apertures 43 of the short gas transfer ports 42 as the piston approaches BDC.

In order to maximise the possible compression ratio of the engine which the fixed separator plate allows, the annular well 23 does not extend fully around the lower cylinder section, where it is not aligned with the long transfer port inlet apertures, as can be seen in the sectioned view of the right hand cylinder in FIG. 2.

As well as the conventional exhaust port control sleeve 25, the pistons of an engine for which the gas transfer port system of the invention is suited, are provided with a shorter skirt 56 diametrically opposite the exhaust skirt 25. This inlet port skirt 56 extends downward from the piston 20 and is substantially coextensive with the area of the outlet aperture of the inlet port 50, as can best be seen in FIG. 2. During the approach of the piston 20 to BDC, when the "squish" effect starts, the rapidly compressing gas between the underside of the piston and the fixed separator plate 18 could transmit a destructive pressure wave up the inlet port to the relatively fragile leaf of the pivot valve 16 in its closed position. This pressure wave is trapped behind the inlet port skirt 56.

Further charge transfer to accommodate the continuing exhaust scavenge, continues above the piston 20 via the opening of the single or booster transfer port 54, compensating for any restriction caused by the inlet port skirt 56. In addition, the "squish" pressure trapped by the skirt 56 is diverted to the short gas transfer ports 42, further exploiting the dynamics of the transfer port system of the invention.

In Use

With reference to the left hand cylinder in FIG. 1, in the gas transfer port arrangement of the invention, a charge of air or air/fuel mixture is drawn via the inlet port 50 into the induction or pressure chamber 17 (which comprises the annular well 23 and the space created between the underside of the piston 20 and the upper surface of the fixed separator plate 18, as the piston rises from BDC to TDC). This is the compression/induction charging stroke of the piston and the compressed charge, previously transferred to the combustion chamber 19 is ignited to initiate the power stroke in which the piston is driven back down towards BDC.

This descent commences to compress the fresh charge in the induction or pressure chamber 19. The pivot valve 16, previously opened by the induction of the charge, is now reversed to its closed position (aided by the suction on the other leaf of the valve due to the partial vacuum formed in the right hand cylinder 12 in which the piston is rising).

The pressure in the induction or pressure chamber 17 increases to a maximum at a point just before the descending piston starts to uncover the outlet apertures 45 of the short and long gas transfer ports. As these are uncovered, the charge issues into the combustion chamber 19 with the long gas transfer ports 44 driven by the accumulated pressure in the compression/induction chamber (including the annular well 23), all moving in the one direction. This uniformity of the flow of the fresh charge from the induction or pressure chamber portion 17 is quite unlike the turbulent transfer from the crankcase of a conventional two-stroke engine.

As the underside of the piston comes into close proximity to the fixed separator plate 18, but before it has reached BDC, there is an accelerated pulse of charge transfer (the so-called "squish" effect) into the short transfer ports 42. This pulse has the effect of assisting the scavenging of the charge from the annular well 23 through the long gas transfer ports 44.

The above describes only some embodiments of the present invention and modifications, obvious to those skilled in the art, can be made thereto without departing from the scope of the present invention.

The invention claimed is:

1. A gas transfer port system for a cylinder of a two-stroke internal combustion engine; said cylinder provided with a fixed separator plate dividing said cylinder into an upper cylinder and a lower cylinder; a piston in said cylinder reciprocating between said separator plate and a cylinder head; and wherein an annular skirt descending from said separator plate forms at least a portion of an annular well between said skirt and an internal surface of said cylinder; said annular well sealed at the bottom such that said upper cylinder is isolated from a crankcase of said engine; said gas transfer port system including at least one short gas transfer port; said short gas transfer port having an inlet aperture at an internal surface of a wall of said cylinder proximate said underside of said piston when at Bottom Dead Centre (BDC); an inlet charge gas under a descending said piston flowing through said short gas transfer port to a gas transfer port outlet aperture in a wall of said cylinder; said gas transfer port outlet aperture located above an upper surface of said piston when at bottom dead centre (BDC); said annular well in communication with said gas transfer port outlet aperture in said wall of said cylinder; said short gas transfer port relieving a rapid rise in pressure causing an accelerated pulse of said inlet charge gas from between an upper surface of said separator plate and an underside of said piston approaching BDC; said pulse of inlet charge gas from said short gas transfer port assisting the scavenging of said inlet charge gas from said annular well for exit through said gas transfer port outlet aperture into said upper cylinder; said annular well forming a long transfer port leading towards said gas transfer port outlet aperture.

2. The system of claim 1 wherein said long gas transfer port and said short gas transfer port form at least one pair of multiple pairs of gas transfer ports.

3. The system of claim 2 wherein passages of each of said pairs of short and long gas transfer ports are curved proximate said common outlet aperture such that gas flows issuing from said common outlet aperture are biased in flow direction towards and above said inlet port.

4. The system of claim 2 wherein a portion of said annular well is blocked so as to reduce the volume of said well; said reduction in volume increasing the available compression ratio of said cylinder.

5. The system of claim 1 wherein said fixed separator plate forms an upper closure of said annular skirt; the diameter of an outer surface of said annular skirt being smaller than the bore of said cylinder, such that said annular well is formed between said outer surface and said bore of said cylinder for at least a part of the circumference of said annular skirt.

6. The system of claim 1 wherein said fixed separator plate and said annular skirt isolate said cylinder from a crankcase of said engine; a lower edge of said annular skirt sealing against an annular ledge at a base of said cylinder.

7. The system of claim 1 wherein said well is of sufficient depth to accommodate an exhaust control skirt when said piston descends to Bottom Dead Centre (BDC); said exhaust control skirt depending from an underside rim of said piston.

8. The system of claim 1 wherein an exhaust port of said cylinder is arranged diametrically opposite an inlet port of said cylinder.

9. The system of claim 8 wherein said cylinder is provided with four pairs of said pairs of gas transfer ports; said four pairs arranged in two diametrically opposing pairs of pairs between said exhaust port and said inlet port.

10. The system of claim 8 wherein a single gas transfer port is arranged aligned axially with an outlet aperture of said inlet port; said single gas transfer port extending from below a level of said upper surface of said separator plate to above an upper surface of said piston when said piston is at BDC; an outlet aperture of said inlet port communicating with said single gas transfer port.

11. The system of claim 10 wherein said piston is provided with an inlet port control skirt; said inlet port control skirt depending from said underside rim of said piston sufficient to block passage of gas from between an underside of said piston and said upper surface of said fixed separator plate, into said outlet aperture of said inlet port when said piston descends to BDC; said skirt extending below said level of said upper surface of said separator plate when said piston is at BDC.

12. The system of claim 8 wherein an underside of said piston is shaped with angled surfaces sweeping upward from a diametric centreline lying between an inlet port side and an exhaust port side of said cylinder; said angled surfaces directing gas flow from between said underside of said piston and said upper surface of said separator plate into said inlet apertures of said short gas transfer ports of said two diametrically opposing pairs of pairs of short and long transfer ports as said piston approaches BDC.

13. A method of transferring gases from an underside of a piston of a cylinder of a two-stroke engine; said method including the steps of providing at least one short gas transfer port; said short gas transfer port having an inlet aperture at an internal surface of a wall of said cylinder proximate said underside of said piston when at Bottom Dead Centre (BDC); an inlet charge gas under a descending said piston flowing through said short gas transfer port to a gas transfer port outlet aperture in a wall of said cylinder; said gas transfer port outlet aperture located above an upper surface of said piston when at BDC; said annular well in communication with said gas transfer port outlet aperture in said wall of said cylinder; said short gas transfer port relieving a rapid rise in pressure causing an accelerated pulse of said inlet charge gas from between an upper surface of said separator plate and an underside of said piston approaching BDC; said pulse of inlet charge gas from said short gas transfer port assisting the scavenging of said inlet charge gas from said annular well for exit through said gas transfer port outlet aperture into said upper cylinder; said annular well forming a long transfer port leading towards said gas transfer port outlet aperture.

14. The method of claim 13, wherein said short gas transfer port extends from a level below an underside of said piston to said common outlet aperture above said upper surface of said piston when said piston is at BDC in said cylinder.

15. The method of claim 13 wherein said well at least partially surrounds said annular skirt depending from said fixed separator plate; said separator plate and said annular skirt isolating an upper section of said cylinder from a crankcase of said engine.

16. The method of claim 13 wherein a charge of gas comprising air or an air/fuel mixture is drawn through an inlet port into a volume defined by said annular well and between said underside of said piston and an upper surface of said fixed separator plate, as said piston rises toward Top Dead Centre (TDC).

17. The method of claim 16 wherein said charge of gas is compressed into said volume as said piston descends from TDC towards BDC; pressure in said pair of gas transfer ports rising to a maximum until said upper surface of said piston descends below an upper edge of said common outlet aperture of said pair of gas transfer ports; said charge then commencing issuing from said common outlet aperture.

18. The method of claim 16 wherein transfer of said charge is boosted by a rapid rise in pressure as separation between said underside of said piston and said upper surface of said separator plate approaches a minimum; said rapid rise in pressure causing an accelerated transfer of said gas through said short transfer port.

19. The method of claim 13 wherein a single gas transfer port directs a flow of said charge across an upper surface of said piston as said piston approaches BDC; said single gas transfer port communicating with an outlet aperture of an inlet port of said cylinder; said single gas transfer port extending from a level below said piston to a level above said upper surface of said piston at BDC.

20. The method of claim 19 wherein said piston is provided with a short inlet port skirt depending from an edge of said piston; said short inlet skirt substantially coextensive with said outlet aperture of said inlet port when said piston is at BDC.

* * * * *